US005255462A

United States Patent [19]

Rufenacht

[11] Patent Number: 5,255,462

[45] Date of Patent: Oct. 26, 1993

[54] SIGN WITH VARIABLE INDICATORS

[76] Inventor: Robert W. Rufenacht, 191 Elderwood Dr., Pleasant Hill, Calif. 94523

[21] Appl. No.: 789,280

[22] Filed: Nov. 8, 1991

[51] Int. Cl.[5] ..... G09F 7/00

[52] U.S. Cl. ..... 40/488; 40/491

[58] Field of Search ..... 40/488, 588, 491, 490, 40/589; 116/323

[56] References Cited

U.S. PATENT DOCUMENTS

| | | | |
|---|---|---|---|
| 929,445 | 7/1909 | Keays | 116/323 |
| 2,214,275 | 9/1940 | Hart | 40/491 |
| 2,592,289 | 4/1952 | Joyner | 40/588 |
| 3,204,639 | 9/1965 | Kleffman | 116/323 X |
| 3,665,626 | 5/1972 | Lund et al. | 40/491 X |
| 4,731,945 | 3/1988 | Howard | 40/488 X |
| 4,783,923 | 11/1988 | Grinwald et al. | 40/488 |

*Primary Examiner*—James R. Brittain
*Assistant Examiner*—Milton Nelson, Jr.
*Attorney, Agent, or Firm*—Bielen, Peterson & Lampe

[57] ABSTRACT

A sign having variable indicators utilizing a static member in the form of a plate with a first surface and a second opposite surface. First and second slots are also provided along the static member between the first and second surfaces. A removable member having first and second surfaces lies adjacent the static member. The movable member includes indicia indicating direction which is capable of aligning with the first and second slots of the first member when the movable first surface moves adjacent the second surface of the static member. The movable member may be confined to the static member to form a sign unit.

6 Claims, 2 Drawing Sheets

SIGN WITH VARIABLE INDICATORS

BACKGROUND OF THE INVENTION

The present invention relates to a novel sign having variable indicators of direction.

Railroad cars employed to transport vehicles generally load all the vehicles facing in one direction. Such loading to facilitate unloading of the cars at the destination terminal which may be a great distance from the loading point. When a rail car arrives at the unloading destination, observers must be assigned to ascertain the facing direction of the vehicles within the railroad car in order to properly switch the railroad cars which results in a proper spotting of a track i.e.: where all the cars are facing the same direction.

It has been found that it is very difficult to ascertain the facing directions of vehicles on a railroad car as a train arrives in the unloading area due to the train's speed, lighting conditions, adverse weather conditions, and the like. Failure to determine the facing directions of a single car results in great expenditure of labor to obtain this information. If the facing direction of a single car is unknown, persons must walk along a railroad track and make a close visual inspection of the rail car to determine the information. An erroneous facing direction observation requires that the switching crew pull, turn, and respot a car facing in the wrong direction while delaying the unloading of other railroad cars. In addition, fuel is expended in unnecessary additional switching of cars.

A device which eliminates unreliable prior art methods of determining the facing direction of vehicles within a railroad car would be a great advance in the transportation field.

SUMMARY OF THE INVENTION

In accordance with the present invention a novel and useful device for indicating the facing direction of vehicles on a railroad car is herein provided.

The device takes the form of a sign which has variable indicators. The sign is constructed with a static member having a first surface and a second opposite surface. A pair of slots are spaced along the static member creating notches between the first and second surfaces of the same. The static member may be in the form of a plate and include mounting openings located apart from the first and second slots.

The device of the present invention also includes a movable member having first and second surfaces opposite one another. The movable member may also be in the form of a plate. The first surface of the movable member may include direction indicating indicia such as arrows or other pointing representations. The movable member is capable of traveling adjacent the second surface of the static member such that the direction indicating indicia aligned with first and second slots of the first member and are, thus, visible through the first and second slots.

Means is also included in the present invention for locking the position of the movable member relative to the static member. Such locking means may take the form of providing a backing member, which may also be in the form of a plate, adjacent the movable member. The backing member could be constructed with a channel along one of its dimensions. A rod connects to the movable member and extends through the channel of the backing member. Means is also included for fixing the rod along the channel which may take the form of notches or additional openings that are adjacent the channel along the backing member. Of course, the rod is fixed to the notches in the channel of the backing member at a position such that the indicia on the movable member are visible through the slots on the fixed member. The rod may also be slidably connected to the movable member which may itself include a slot that is substantially parallel to any of the notches of the channel of the backing member. The rod extends through the slot of the movable member and is confined to the same by fastener. In this manner, the movable member need not travel transversely to its normal sliding path when changing the indicia appearing through the slots in the fixed member.

It may be apparent that a novel and useful sign having variable indicators has been described.

It is therefore an object of the present to provide a sign having variable indicators which is conveniently used on a railroad car to show the facing direction of vehicles carried by that railroad car.

It is another object of the present invention to provide a sign having variable indicators which is easily manipulated and mounted on a railroad car such that unauthorized changing of indicators is prevented.

It is a further object of the present invention to provide a sign having variable indicators which is sturdy in construction and contains a minimum of moving parts.

Another object of the present invention is to provide a sign having variable indicators which eliminates great time, costs, and labor involved in unloading vehicle containing railroad cars.

The invention possesses other objects and advantages especially as concerns particular characteristics and features thereof which will become apparent as the specification continues.

Figure 1:
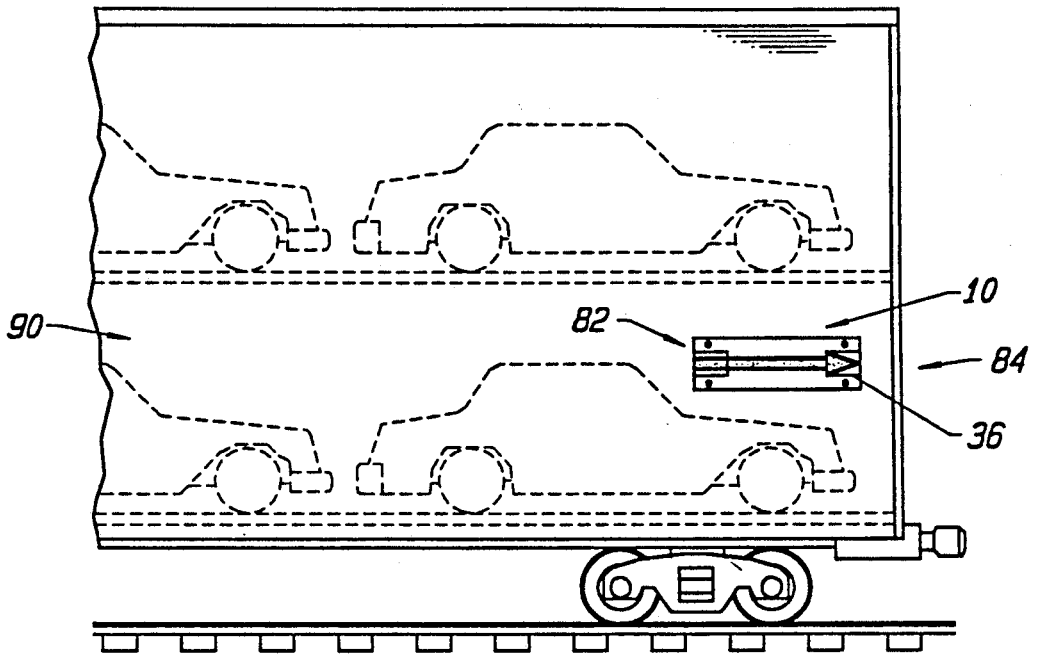
FIG. 1 is a broken side elevational view of a railroad car showing the sign of the present invention mounted thereupon.

For a better understand of the invention reference is made to the following detailed description of the preferred embodiments which should be referenced to the prior described drawings.

DESCRIPTION OF THE PREFERRED EMBODIMENTS

Various aspects of the present invention will evolve from the following detailed description of the preferred embodiments which should be taken in conjunction with the heretofore described drawings.

The invention as a whole is represented in the drawings by reference character 10. The sign 10 includes as one of its elements a static member 12, FIGS. 2 and 4, having a first surface 14 and a second surface 16. Static member 12 includes a first slot 18 at end 20 and a second slot 22 at end 24. Slots 18 and 22 extend through first and second surfaces 14 and 16 and constitute open spaces. Static member 12 may be in the form of a metal plate and include a plurality of mounting openings 26 which are aligned with other mounting openings in portions of sign 10 which will be discussed hereinafter. Reflective strip 28 serves as a portion of a directional indicia which will also be further discussed.

Figure 4:
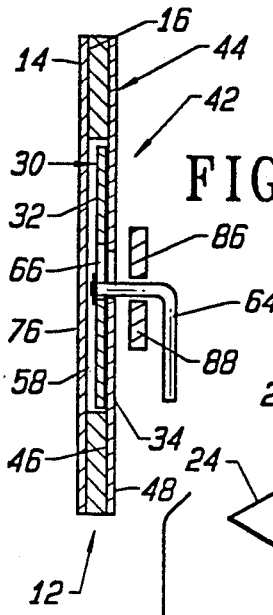
FIG. 4 is a sectional view taken along line 4—4 of FIG. 3.
Figure 7:
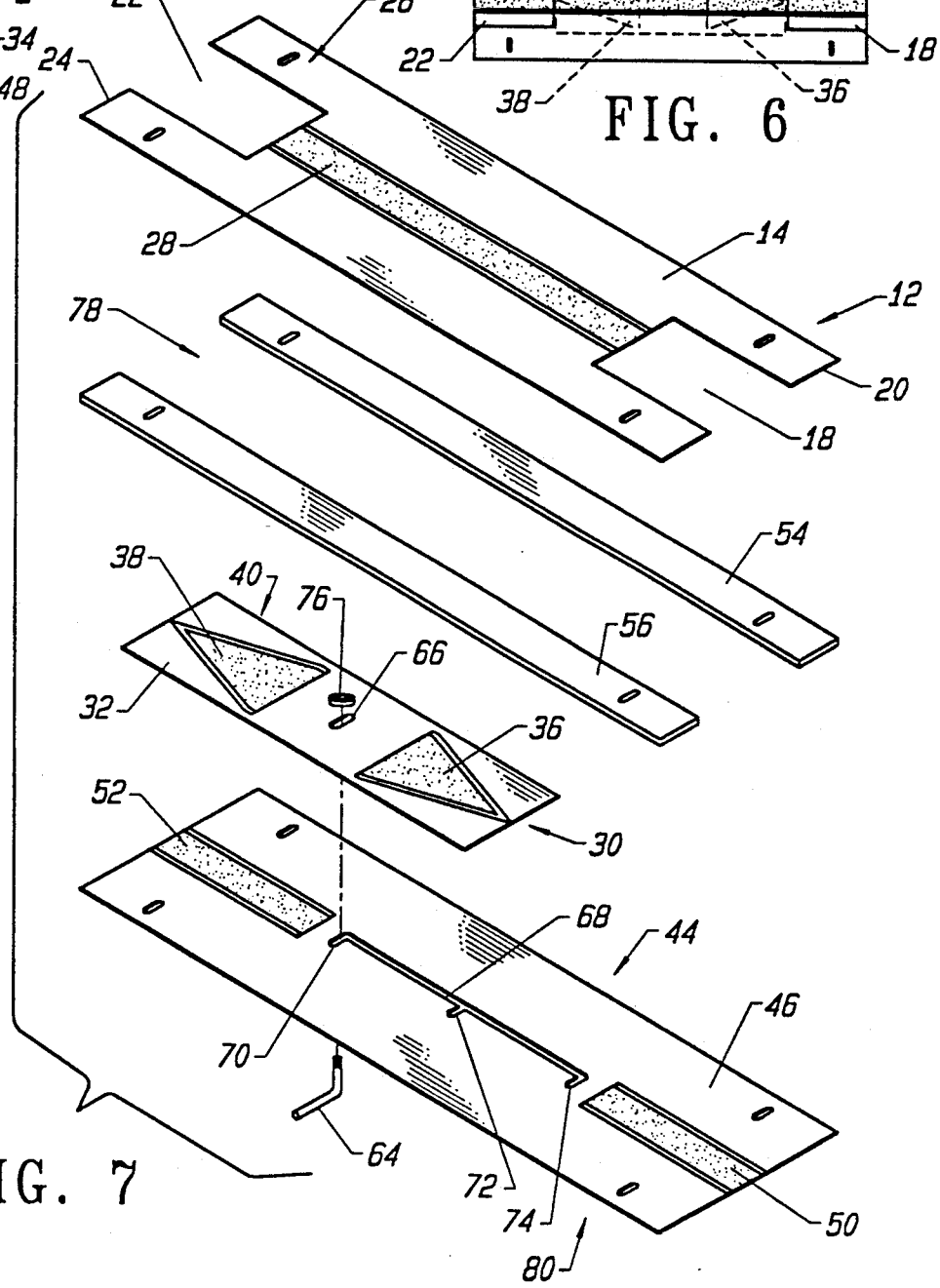
FIG. 7 is a top right isometric exploded view of the sign of the present invention.

Turning now to FIGS. 4 and 7, sign 10 further includes a movable member 30 having a first surface 32 and a second surface 34. Again, movable member 30 may be in the form of a metal plate having arrowheads 36 and 38 which is capable of aligning with reflective strip 28 and being visible at slots 18 or 22 of static member 12. Arrowheads 36 and 38 may be considered direction indicating indicia 40.

Figure 3:
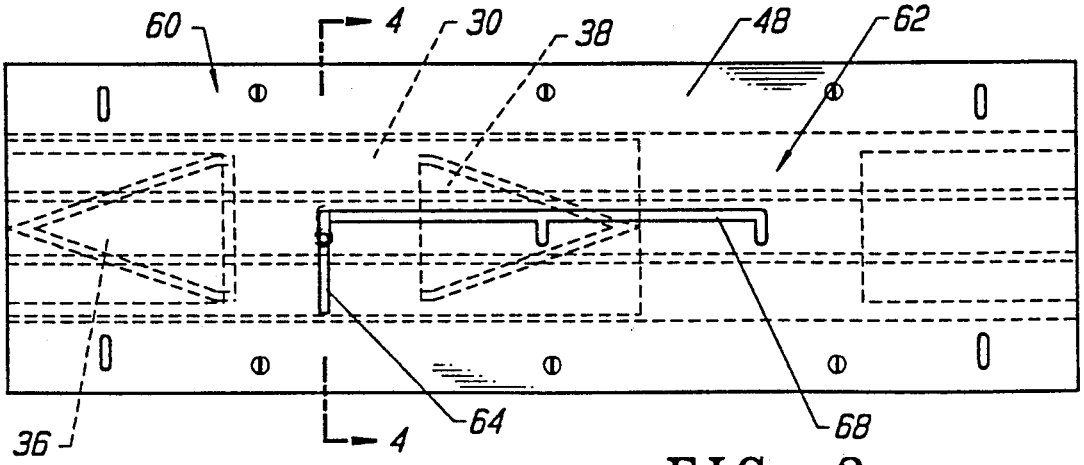
FIG. 3 is rear elevational view of the sign of the present invention.

Means 42, FIGS. 4 and 7, is also shown in the drawings for confining movable member 30 to the vicinity of the static member 12. Means 42 may take the form of a backing member 44 externalized in a metallic plate having a first surface 46 and a second surface 48, which serves as the rear surface of sign 10. Backing member 44 includes reflective strips 50 and 52 which serve as indication of a neutral position i.e.: no directional indication of sign 10, in conjunction with strip 28. Connecting bars 54 and 56 fasten to surface 46 of backing member 44 and surface 16 of static member 12. A chamber 58 is thus formed between static member 12 and backing member 44, FIG. 4. Chamber 58 permits movable member 30 to slide back and forth relative to static member 12. Plurality of fasteners 60, FIG. 3, hold together static member 12, connecting bars 54 and 56, and backing member 44.

Means 62 is also provided in the present invention for locking the position of movable member 30 relative to static member 12. Means 62 may take the form of a structural element such as rod 64 which is depicted as being L-shaped. Rod 64 extends through a slot 66 of movable member 30 and through slot 68 of backing member 44 which extends generally along the axis of movement of movable member 30. Slot 68 includes notches 70, 72, and 74 which lie parallel to the axis of elongation of slot 66. Fastener 76 prevents rod 64 from moving outwardly from slot 66 of movable member 30, yet permits rod to slide up and down slot 66 thereof.

It should be noted that connecting bars 54 and 56 include plurality of openings 78, and backing member 44 includes plurality of openings 80 which align with plurality of openings 26 of static member 12. Such openings form a quartet of bores 82, FIG. 5, through sign 10 permitting sign 10 to be mounted to objects such as railroad car 84, FIG. 1. Such mounting would place the sign at the exterior of railroad car 84 while rod 64 would extend to the interior thereof. Rod 64 would be permitted slide along railroad car 84 which generally has slats, such as slats 86 and 88, FIG. 4 allowing such sliding of rod 64 back and forth. With reference to FIG. 1, it may be apparent that the vehicles 90 are facing to the right, coinciding with the directional arrow shown on sign 10.

Figure 2:
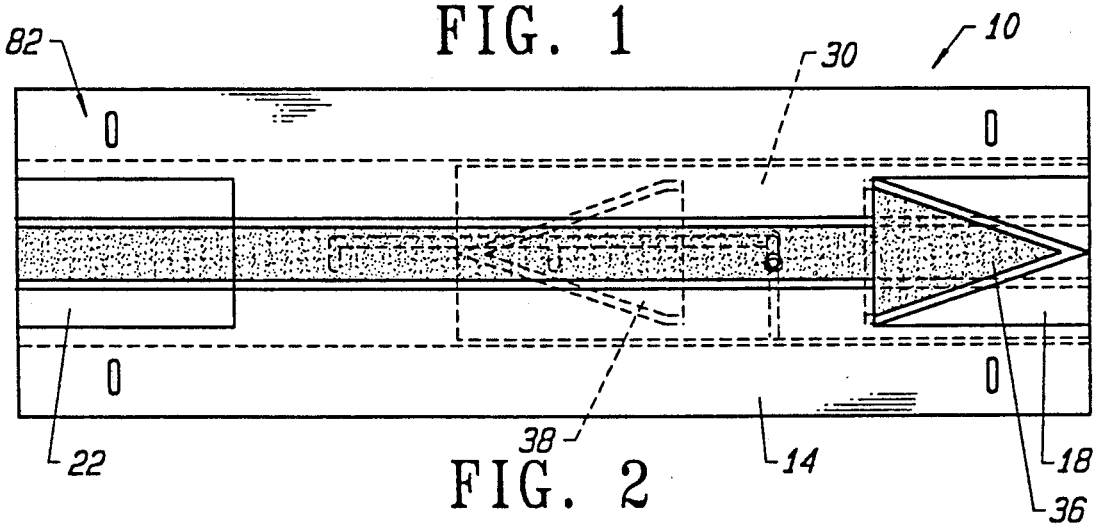
FIG. 2 is a front elevational view of the sign of the present invention.
Figure 5:
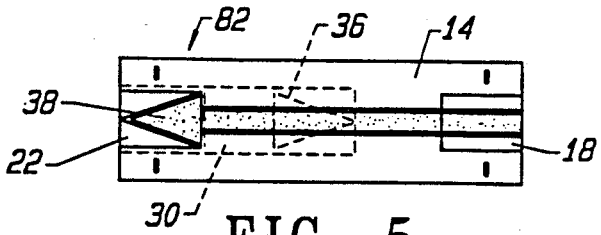
FIG. 5 is a front elevational view of the sign of the present indicating left facing vehicles.
Figure 6:
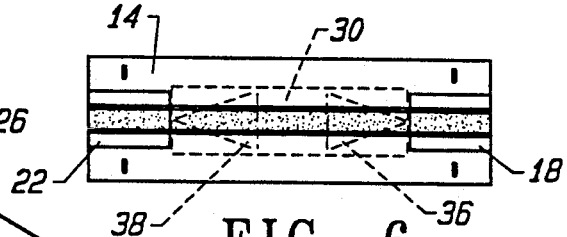
FIG. 6 is a front elevational view of the sign of the present invention indicating a neutral direction indicating position.

In operation, the user affixes sign 10 to railroad car 84 such that sign 10 is visible on the exterior of the railroad car 84 and rod 64 extends to the interior of railroad car 84 between slats or other openings. Quartet of bores 82 also permits the mounting of sign 10 with suitable fasteners. At this point movable member 30 may be slid back and forth relative to static member 12 within chambers 58. With reference to FIG. 5, it may be observed that movable member 30 has traveled to the left to expose arrowhead 38 indicating left facing cars. With reference to FIG. 2, it may be observed that the opposite has taken place such that arrowhead 36 is visible indicating right facing cars, which is the case of the cars 90 depicted in FIG. 1. With reference to FIG. 6, movable member 30 lies in a neutral position such that neither arrowhead 36 nor arrowhead 38 is visible through slots 18 or 22 of static member 12. Handle 64 is grasped by the user to place movable member 30 in any of these positions. To effect this maneuver, rod 64 is lifted within slots 66 of movable member 30 until it is able to pass along slot 68 of backing member 44. Notches 70, 72, and 74 then determine the resting position of movable member 30 which coincides with the left pointing, right pointing, or neutral position of sign 10 shown in FIGS. 2, 5, and 7, respectively.

While in foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A sign having variable indicators comprising:

a. a static member having a first surface and a second surface and further comprising a first slot and a second slot spaced along said static member between said first and second surfaces;

b. a movable member including a first surface and a second surface, said first surface of said movable member including direction indicating indicia, said movable member first surface being capable of traveling adjacent said second surface of said static member such that said direction indicating indicia align with said static and second slots of said first member;

c. a backing member adjacent said movable member, said backing member having a channel therealong;

d. a structural element connected to said movable member and extending through said channel of said backing member said structural element being accessible adjacent said backing member;

e. hold means for removably fixing said structural element along said channel; and f. guiding means for confining said movable member to the vicinity of said static member.

2. The sign of claim 1 in which said holding means for removably fixing said structural element along said channel includes at least one notch in said channel.

3. The sign of claim 1 in which said structural element is a rod, said rod is slidably connected to said movable member, and said movable member includes a slot, said rod extending through said slot of said movable member and being capable of moving along said slot of said movable member, and further includes means for confining said rod to said slot of said movable member.

4. The sign of claim 1 in which said backing member connects to said static member to form a chamber for travel of said movable member relative to said static member, said chamber serving as said guiding means for confining said movable member to the vicinity of said static member.

5. The sign of claim 4 in which said movable member, said static member and said backing member are plates.

6. The sign of claim 4 which additionally comprises means for mounting said static and connected backing members to a surface.

* * * * *